US005897295A

United States Patent [19]

Rogers et al.

[11] Patent Number: 5,897,295

[45] Date of Patent: Apr. 27, 1999

[54] TIMER CONTROLLED PNEUMATIC WATER PUMP

[76] Inventors: Tommy R. Rogers, Co. Road 208 Box 541, Bridgeport, Ala. 35740; Leonard L. Cofer, 2482 Francis Spring Rd., Jasper, Tenn. 37347; Bueford Porter, 806 Brummel Ave. P.O. Box 1058, Bridgeport, Ala. 35740

[21] Appl. No.: 08/988,831

[22] Filed: Dec. 11, 1997

[51] Int. Cl.[6] ..... F04F 1/06; F04B 49/02

[52] U.S. Cl. ..... 417/12; 417/46; 417/118; 417/120

[58] Field of Search ..... 417/12, 46, 120, 417/118

[56] References Cited

U.S. PATENT DOCUMENTS 5,092,743 3/1992 Dietrich ..... 417/392

5,525,042 6/1996 Batten ..... 417/118

5,749,711 5/1998 Park ..... 417/120

*Primary Examiner*—Charles G. Freay

*Assistant Examiner*—Paul L. Ratcliffe

[57] ABSTRACT

A pneumatic pump is provided including a housing with an inlet aperture and an outlet aperture. A one way valve is mounted on the inlet aperture. A tube has a first end connected to outlet aperture and a second end positioned distant the housing. An air compressor resides in communication with the housing via a conduit. The air compressor serves to continuously elevate the pressure of air within the conduit. A solenoid valve allows the flow of the pressurized air to the housing only upon the actuation thereof. When the solenoid is actuated, the pressure within the interior of the housing is elevated above that of the exterior such that the valve is closed and the water within the housing is excreted through the outlet pipe. Finally, a timer is connected to the solenoid valve to actuate the same at user selected time intervals.

8 Claims, 3 Drawing Sheets

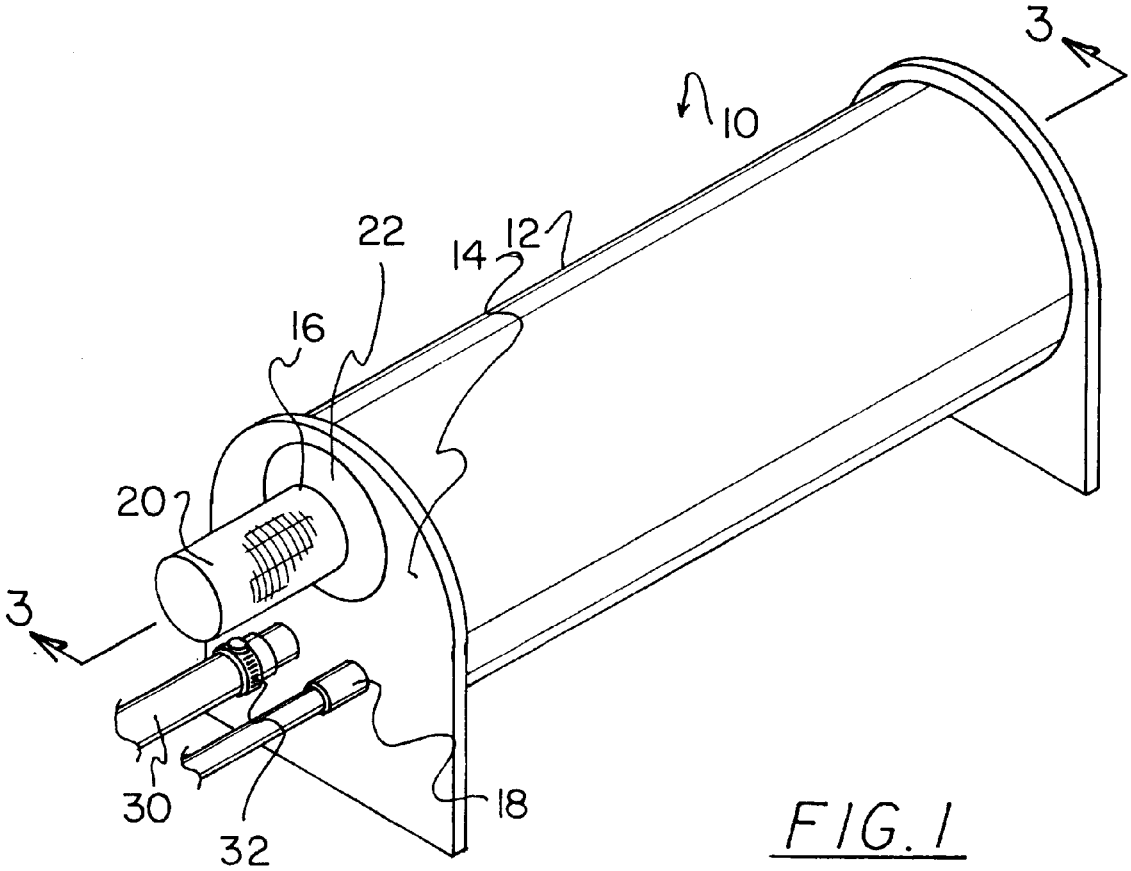
FIG. 1
FIG. 2
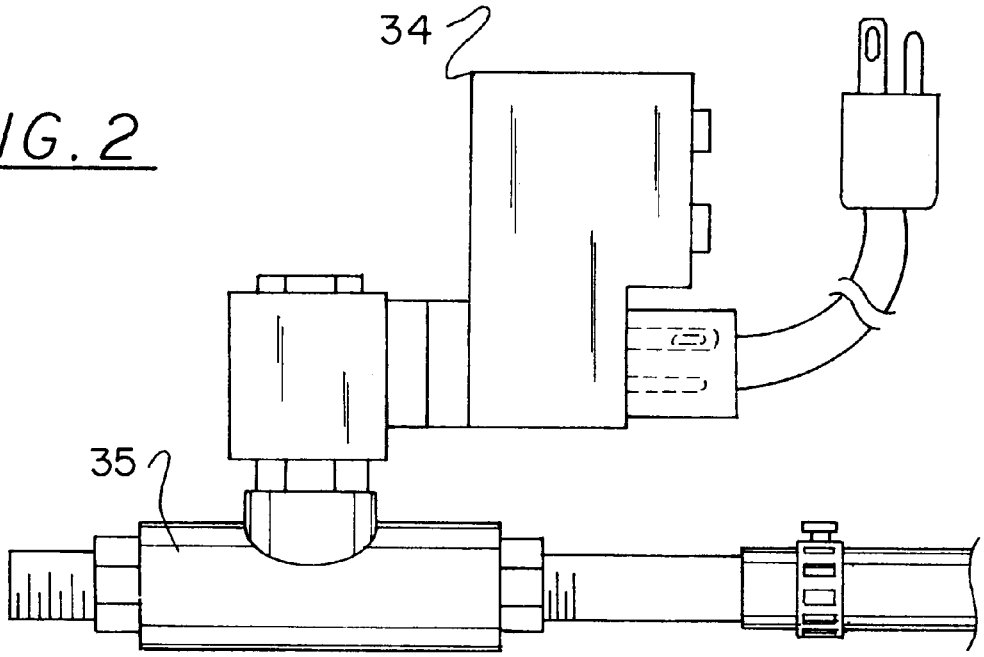

TIMER CONTROLLED PNEUMATIC WATER PUMP

BACKGROUND OF THE INVENTION

1. Field of the Invention

The present invention relates to electrical and mechanical pumps and more particularly pertains to a new timer controlled pneumatic water pump for safely pumping water via pneumatic means at predetermined time intervals.

2. Description of the Prior Art

The use of electrical and mechanical pumps is known in the prior art. More specifically, electrical and mechanical pumps heretofore devised and utilized arc known to consist basically of familiar, expected and obvious structural configurations, notwithstanding the myriad of designs encompassed by the crowded prior art which have been developed for the fulfillment of countless objectives and requirements.

Known prior art electrical and mechanical pumps include U. S. Pat. No. 5,092,743; U.S. Pat. No. 5,074,758; U.S. Pat. No. 4,321,017; U.S. Pat. No. 5,451,144; U.S. Pat. No. 4,021,147; and U.S. Pat. No. Des. 244,681.

In these respects, the timer controlled pneumatic water pump according to the present invention substantially departs from the conventional concepts and designs of the prior art, and in so doing provides an apparatus primarily developed for the purpose of safely pumping water via pneumatic means at predetermined time intervals.

SUMMARY OF THE INVENTION

In view of the foregoing disadvantages inherent in the known types of electrical and mechanical pumps now present in the prior art, the present invention provides a new timer controlled pneumatic water pump construction wherein the same can be utilized for safely pumping water via pneumatic means at predetermined time intervals.

The general purpose of the present invention, which will be described subsequently in greater detail, is to provide a new timer controlled pneumatic water pump apparatus and method which has many of the advantages of the electrical and mechanical pumps mentioned heretofore and many novel features that result in a new timer controlled pneumatic water pump which is not anticipated, rendered obvious, suggested, or even implied by any of the prior art electrical and mechanical pumps, either alone or in any combination thereof.

To attain this, the present invention generally comprises a housing having a rigid hollow cylinder with a pair of planar face plates each mounted to an associated one of the ends thereof. As shown in FIG. 1, each face plate has a semicircular top periphery coincident with a periphery of the associated end of the cylinder. A lower linear periphery of each face plate is horizontally oriented to rest on a recipient surface under water. As such, the cylinder is elevated from the recipient surface and an axis thereof resides in parallel relationship therewith. One of the face plates has a first large aperture formed therein adjacent to the top periphery of the face plate. Associated therewith is a pair of small apertures formed therein below the large aperture. Next provided is a cylindrical screen having an open end with a peripheral flange coupled thereto and extending radially therefrom. The flange is mounted to one of the face plates about the large aperture such that an axis of the cylindrical screen resides in parallel relationship with that of the cylinder of the housing. A one way valve includes an elastomeric flap mounted to an inner surface of the face plate over the large aperture, as shown in FIGS. 3 & 4. An L-shaped stopper is integrally coupled to the inner surface of the face plate below the large aperture. A vertical extent of the L-shaped stopper extends upwardly in spaced parallel relationship with the associated face plate. By this structure, the elastomeric flap has an open biased orientation in abutment with the vertical extent of the stopper. In such orientation, the flap is adapted for allowing water to enter the cylinder of the housing through the cylindrical screen. This occurs only when the pressure exterior of the housing is greater than an interior thereof. The flap further has a closed unbiased orientation covering the large aperture for precluding water from entering the housing when the pressure exterior of the housing is less than the interior thereof. FIG. 3 shows a rigid outlet pipe situated through one of the small apertures. The outlet pipe has a first open end situated within the housing adjacent the face plate opposite that with the apertures. A second open end of the outlet pipe is situated exterior of the housing. For dispensing water, a flexible tube is provided with a first end connected to the second open end of the outlet pipe and a second end positioned distant the housing. An air compressor is connected to a remaining one of the small apertures of the housing via a conduit. During use, the air compressor functions to continuously elevate the pressure of air within the conduit. A solenoid valve is mounted on the conduit between the air compressor and the housing. The solenoid serves for allowing the flow of the pressurized air to the housing only upon the actuation thereof. Upon actuation, the pressure within the interior of the housing is elevated above that of the exterior such that the elastomeric flap is closed and the water within the housing is excreted through the outlet pipe. Finally, timer means is connected to the solenoid valve to actuate the same at user selected time intervals.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new timer controlled pneumatic water pump apparatus and method which has many of the advantages of the electrical and mechanical pumps mentioned heretofore and many novel features that result in a new timer controlled pneumatic water pump which is not anticipated, rendered obvious, suggested, or even implied by any of the prior art electrical and mechanical pumps, either alone or in any combination thereof.

It is another object of the present invention to provide a new timer controlled pneumatic water pump which may be easily and efficiently manufactured and marketed.

It is a further object of the present invention to provide a new timer controlled pneumatic water pump which is of a durable and reliable construction.

An even further object of the present invention is to provide a new timer controlled pneumatic water pump which is susceptible of a low cost of manufacture with regard to both materials and labor, and which accordingly is then susceptible of low prices of sale to the consuming public, thereby making such timer controlled pneumatic water pump economically available to the buying public.

Still yet another object of the present invention is to provide a new timer controlled pneumatic water pump which provides in the apparatuses and methods of the prior art some of the advantages thereof, while simultaneously overcoming some of the disadvantages normally associated therewith.

Still another object of the present invention is to provide a new timer controlled pneumatic water pump for safely pumping water via pneumatic means at predetermined time intervals.

Even still another object of the present invention is to provide a new timer controlled pneumatic water pump that includes a housing with an inlet aperture and an outlet aperture. A one way valve is mounted on the inlet aperture. A tube has a first end connected to outlet aperture and a second end positioned distant the housing. An air compressor resides in communication with the housing via a conduit. The air compressor serves to continuously elevate the pressure of air within the conduit. A solenoid valve allows the flow of the pressurized air to the housing only upon the actuation thereof. When the solenoid is actuated, the pressure within the interior of the housing is elevated above that of the exterior such that the valve is closed and the water within the housing is excreted through the outlet pipe. Finally, a timer is connected to the solenoid valve to actuate the same at user selected time intervals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new timer controlled pneumatic water pump according to the present invention.

FIG. 2 is a side view of the air compressor and solenoid of the present invention.

DESCRIPTION OF THE PREFERRED EMBODIMENT

Figure 3:
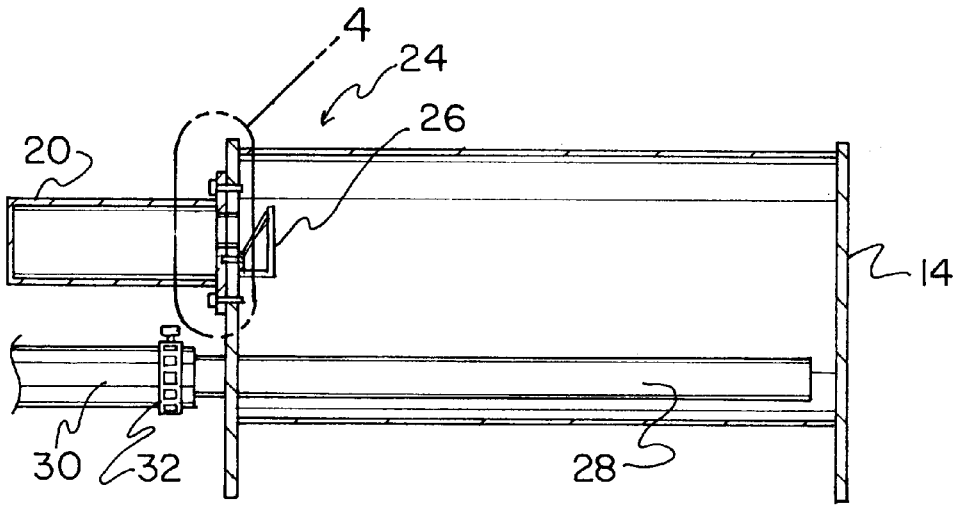
FIG. 3 is a side cross-sectional of the present invention taken along line 3—3 shown in FIG. 1.

With reference now to the drawings, and in particular to FIGS. 1 through 5 thereof, a new timer controlled pneumatic water pump embodying the principles and concepts of the present invention and generally designated by the reference numeral 10 will be described.

The present invention, as designated as numeral 10, includes a housing 12 having a rigid hollow cylinder with a pair of planar face plates 14 each mounted to an associated one of the ends thereof. As shown in FIG. 1, each face plate has a semicircular top periphery coincident with a periphery of the associated end of the cylinder. A lower linear periphery of each face plate is horizontally oriented to rest on a recipient surface under water. As such, the cylinder is elevated from the recipient surface and an axis thereof resides in parallel relationship therewith.

One of the face plates has a first large aperture 16 formed therein adjacent to the top periphery of the face plate. Associated therewith is a pair of small apertures 18 formed therein below the large aperture.

Next provided is a cylindrical screen 20 having an open end with a peripheral flange 22 coupled thereto and extending radially therefrom. The flange is mounted to one of the face plates about the large aperture such that an axis of the cylindrical screen resides in parallel relationship with that of the cylinder of the housing. As shown in FIG. 1, the screen is formed entirely of a meshed material.

Figure 4:
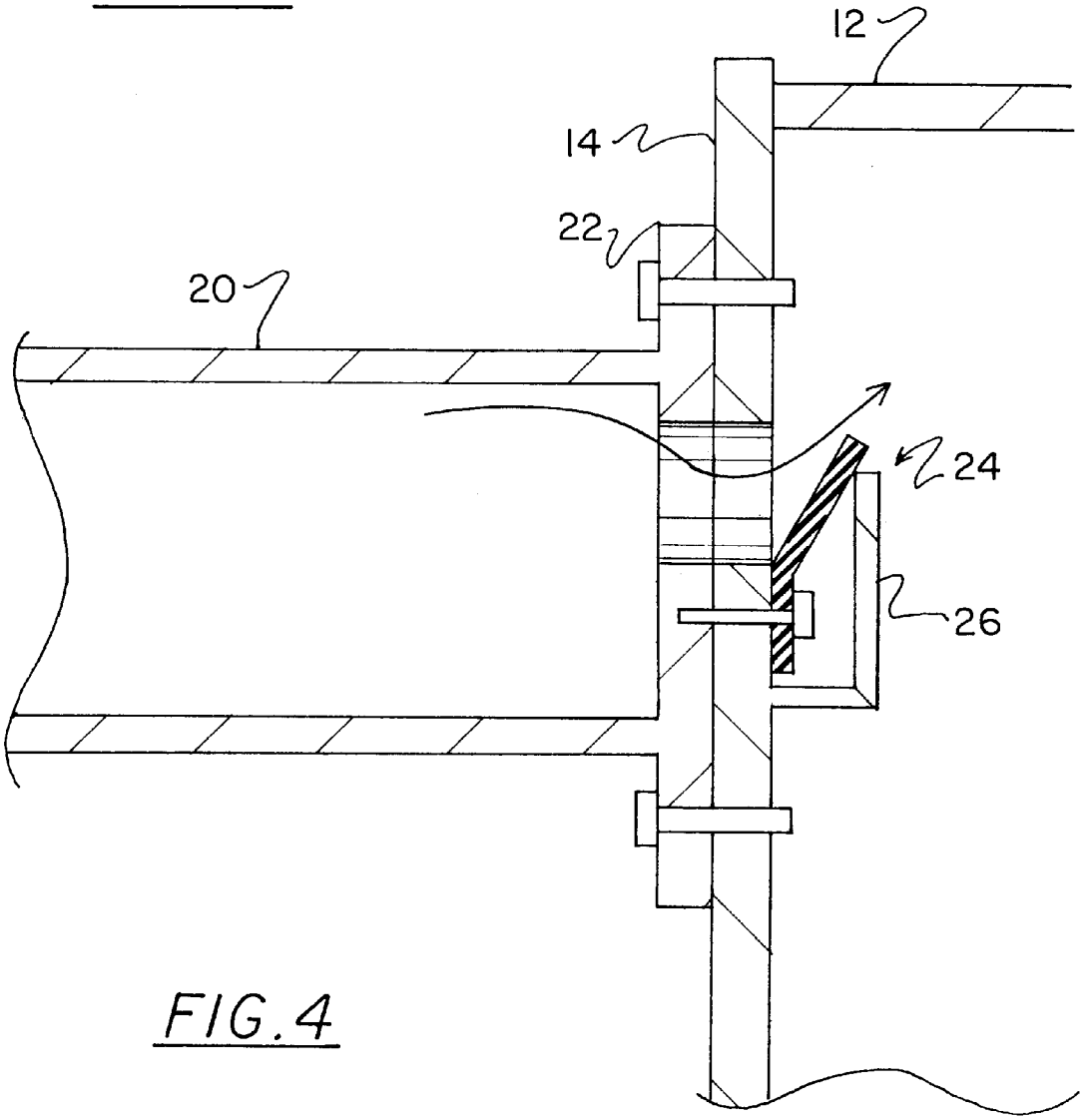
FIG. 4 is a close-up view of the area encircled in FIG. 3.
Figure 5:
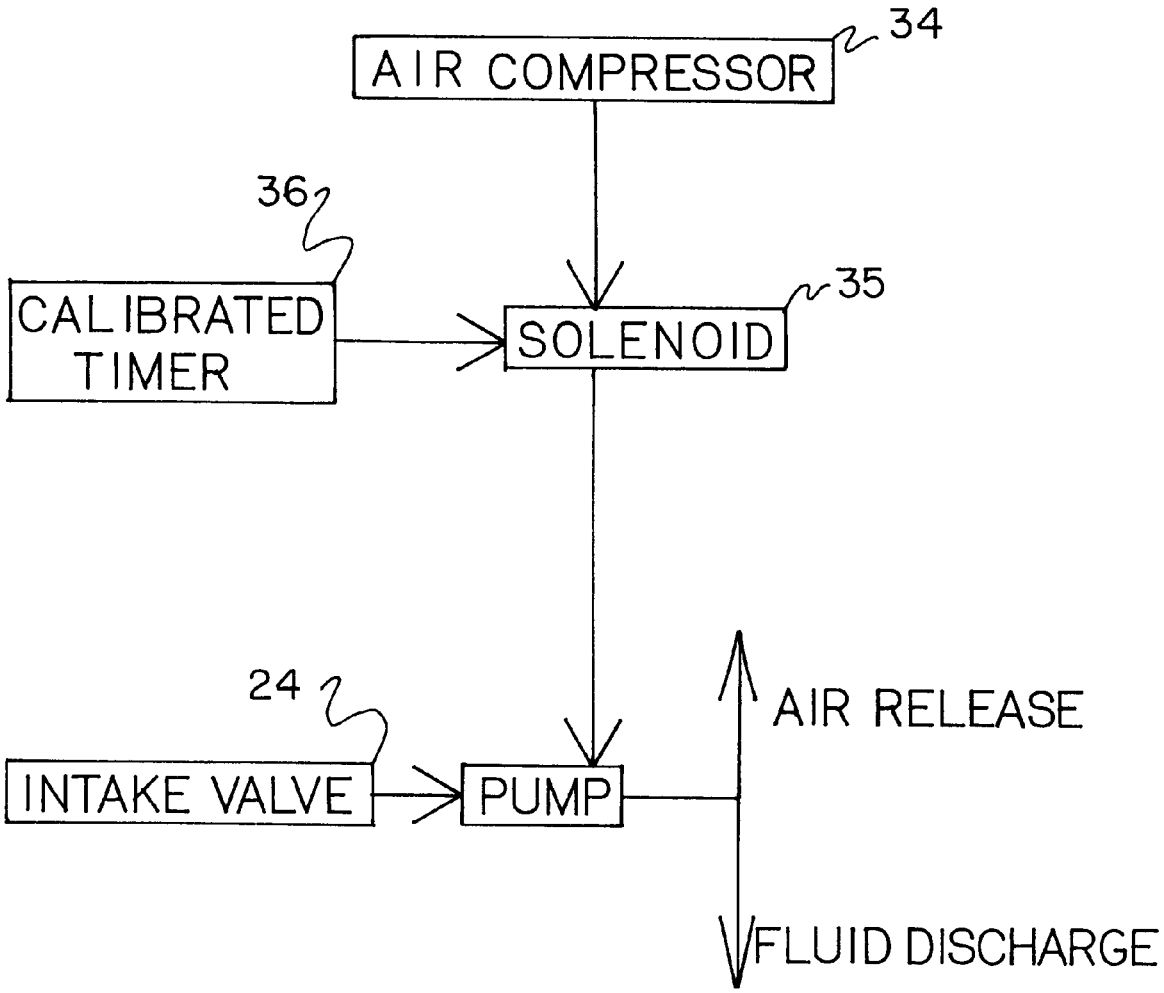
FIG. 5 is a flow chart delineating the operation of the present invention.

A one way valve 24 includes a circular elastomeric flap mounted to an inner surface of the face plate over the large aperture, as shown in FIGS. 3 & 4. An L-shaped stopper is integrally coupled to the inner surface of the face plate below the large aperture. A vertical extent 26 of the L-shaped stopper extends upwardly in spaced parallel relationship with the associated face plate.

By this structure, the elastomeric flap has an open biased orientation in abutment with the vertical extent of the stopper. It should be noted that the stopper prevents the flap from forming an angle with the face plate that exceeds 45 degrees. In such orientation, the flap is adapted for allowing water to enter the cylinder of the housing through the cylindrical screen. This occurs only when the pressure exterior of the housing is greater than an interior thereof. The flap further has a closed unbiased orientation covering the large aperture for precluding water from entering the housing when the pressure exterior of the housing is less than the interior thereof.

FIG. 3 shows a rigid outlet pipe 28 situated through one of the small apertures. The outlet pipe has a first open end situated within the housing adjacent the face plate opposite that with the apertures. A second open end of the outlet pipe is situated exterior of the housing. The outlet pipe preferably has a length equal to that of the housing. For dispensing water, a flexible tube 30 is included with a first end connected to the second open end of the outlet pipe and a second end positioned distant the housing. Such interconnection is ideally accomplished by way of a pipe connector 32.

An air compressor 34 is connected to a remaining one of the small apertures of the housing via a conduit. During use, the air compressor functions to continuously elevate the pressure of air within the conduit such that a predetermined pressure is maintained therein.

A solenoid valve 35 is mounted on the conduit between the air compressor and the housing. See FIG. 2. The solenoid serves for allowing the flow of the pressurized air to the housing only upon the actuation thereof. Upon actuation, the pressure within the interior of the housing is elevated above that of the exterior such that the elastomeric flap is closed and the water within the housing is excreted through the outlet pipe. Finally, timer means 36 is connected to the solenoid valve to periodically actuate the same at user selected time intervals. In the preferred embodiment, the time intervals are set to equal the time required for the housing to fill with water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pneumatic pump comprising, in combination:

a housing including a rigid hollow cylinder with a pair of planar face plates each mounted to an associated one of the ends thereof, each face plate having a semicircular top periphery coincident with a periphery of the associated end of the cylinder and a lower linear periphery that is horizontally oriented to rest on a recipient surface under water such that the cylinder is elevated from the recipient surface and an axis thereof resides in parallel relationship therewith, one of the face plates having a first large aperture formed therein adjacent to the top periphery of the face plate and a pair of small apertures formed therein below the large aperture;

a cylindrical screen having an open end with a peripheral flange coupled thereto and extending radially therefrom, the flange mounted to one of the face plates about the large aperture such that an axis of the cylindrical screen resides in parallel relationship with that of the cylinder of the housing;

a one way valve including an elastomeric flap mounted to an inner surface of the face plate over the large aperture and an L-shaped stopper integrally coupled to the inner surface of the face plate below the large aperture wherein a vertical extent thereof extends upwardly in spaced parallel relationship with the associated face plate, whereby the elastomeric flap has an open biased orientation in abutment with the vertical extent of the stopper for allowing water to enter the cylinder of the housing through the cylindrical screen only when the pressure exterior of the housing is greater than the interior pressure thereof and a closed unbiased orientation covering the large aperture for precluding water from entering the housing only when the pressure exterior of the housing is less than the interior thereof;

an rigid outlet pipe situated through one of the small apertures and having a first open end situated within the housing adjacent the face plate opposite that with the apertures and a second open end situated exterior of the housing;

a flexible tube with a first end connected to the second open end of the outlet pipe with a second end positioned distant the housing;

an air compressor connected to a remaining one of the small apertures of the housing via a conduit, the air compressor adapted to continuously elevate the pressure of air within the conduit;

a solenoid valve mounted on the conduit between the air compressor and the housing for allowing the flow of the pressurized air to the housing only upon the actuation thereof, whereby the pressure within the interior of the housing is elevated above that of the exterior such that the elastomeric flap is closed and the water within the housing is excreted through the outlet pipe; and timer means connected to the solenoid valve to actuate the same at user selected time intervals.

2. A pneumatic pump comprising:

a housing with an inlet aperture and an outlet aperture;

a one way valve mounted on the inlet aperture, whereby the valve has an opening for allowing water to enter the cylinder of the housing when the pressure exterior of the housing is greater than the interior pressure thereof and a closed orientation covering the inlet aperture for precluding water from entering the housing only when the pressure exterior of the housing is less than the interior thereof;

a tube with a first end connected to the outlet aperture and a second end positioned distant the housing;

an air compressor in communication with the housing via a conduit, the air compressor adapted to continuously elevate the pressure of air within the conduit;

a solenoid valve mounted on the conduit between the air compressor and the housing for allowing the flow of the pressurized air to the housing only upon the actuation thereof, whereby the pressure within the interior of the housing is elevated above that of the exterior such that the valve is closed and the water within the housing is excreted through the outlet pipe; and timer means connected to the solenoid valve to actuate the same at user selected time intervals.

3. A pneumatic pump as set forth in claim 2 wherein the housing includes a rigid hollow cylinder.

4. A pneumatic pump as set forth in claim 2 wherein the housing is adapted to rest on a recipient surface under water such that the cylinder is elevated from the recipient surface and an axis thereof resides in parallel relationship therewith.

5. A pneumatic pump as set forth in claim 2 wherein a screen is mounted over the inlet aperture.

6. A pneumatic pump as set forth in claim 2 wherein a rigid outlet pipe is situated through the outlet apertures and has a first open end situated within the housing and a second open end situated exterior of the housing and connected to the tube.

7. A pneumatic pump as set forth in claim 2 wherein the one-way valve comprises an elastomeric flap mounted to an inner surface of housing over the inlet aperture.

8. A pneumatic pump as set forth in claim 7 wherein an L-shaped stopper is integrally coupled to the inner surface of the housing below the inlet aperture wherein a vertical extent thereof extends upwardly in spaced parallel relationship with the housing.

* * * * *